US006221445B1

(12) United States Patent
Jones

(10) Patent No.: US 6,221,445 B1
(45) Date of Patent: Apr. 24, 2001

(54) COMPOSITE ARTIFICIAL TURF STRUCTURE WITH SHOCK ABSORPTION AND DRAINAGE

(75) Inventor: James Martin Jones, Pendleton, SC (US)

(73) Assignee: U.S. Greentech, Inc., Calhoun, GA (US)

( * ) Notice: Subject to any disclaimer, the term of this patent is extended or adjusted under 35 U.S.C. 154(b) by 0 days.

(21) Appl. No.: 09/357,044

(22) Filed: Jul. 20, 1999

(51) Int. Cl.[7] ..... A01N 3/00; A41G 1/00

(52) U.S. Cl. ..... 428/17; 428/95; 428/92; 428/87; 405/36; 405/38; 405/43; 405/45

(58) Field of Search ..... 428/17, 95, 87, 428/92, 15; 405/36, 43, 45, 38

(56) References Cited

U.S. PATENT DOCUMENTS

| | | | | |
|---|---|---|---|---|
| 3,003,643 | | 10/1961 | Thomas | 210/491 |
| 3,795,180 | | 3/1974 | Larsen | 94/33 |
| 4,188,154 | | 2/1980 | Izatt | 405/43 |
| 4,268,551 | * | 5/1981 | Moore, Jr. . | |
| 4,462,184 | | 7/1984 | Cunningham | 47/58 |
| 4,497,853 | * | 2/1985 | Tomarin . | |
| 4,749,479 | | 6/1988 | Gray | 210/170 |
| 4,913,596 | | 4/1990 | Lambert, III | 405/43 |
| 4,934,865 | | 6/1990 | Varkonyi et al. | 405/50 |
| 5,017,040 | | 5/1991 | Mott | 405/32 |
| 5,064,308 | | 11/1991 | Almond et al. | 405/43 |
| 5,076,726 | | 12/1991 | Heath | 405/38 |
| 5,250,340 | * | 10/1993 | Bohnhoff . | |
| 5,306,317 | * | 4/1994 | Yoshizaki . | |
| 5,383,314 | | 1/1995 | Rothberg | 52/169 |
| 5,460,867 | * | 10/1995 | Magnuson et al. . | |
| 5,688,073 | | 11/1997 | Brodeur et al. | 405/45 |
| 5,752,784 | | 5/1998 | Motz et al. | 405/37 |
| 5,780,144 | | 7/1998 | Bradley | 428/217 |
| 5,820,296 | | 10/1998 | Goughnour | 405/43 |
| 5,823,711 | | 10/1998 | Herd et al. | 405/36 |
| 5,848,856 | * | 12/1998 | Bohnhoff . | |
| 5,908,673 | * | 6/1999 | Muhlberger . | |

* cited by examiner

*Primary Examiner*—Deborah Jones
*Assistant Examiner*—Wendy Boss
(74) *Attorney, Agent, or Firm*—Flint & Kim, P.A.

(57) ABSTRACT

An artificial turf is disclosed which comprises an outer artificial grass layer having a generally uniform exterior playing surface. A deflection layer is disposed below the artificial grass layer. The deflection layer has a prescribed height to provide resiliency for absorbing impact shocks from foot traffic and playing on the artificial grass layer. The deflection layer has a plurality of interstices providing open passages for water drainage; and loose particles are dispersed into the interstices of the deflection layer up to a prescribed level to provide stability and enhance shock absorption so that the deflection layer deflects when the artificial grass is impacted to assist in absorbing the impact and maintain normal playing action of the playing surface of the artificial grass layer. A base surface is disposed below aid deflection layer which includes a flexible grid system having a plurality of individual cells interconnected together to provide flexibility and conform to the contour of a compacted subbase surface.

29 Claims, 3 Drawing Sheets

Fig. 6.
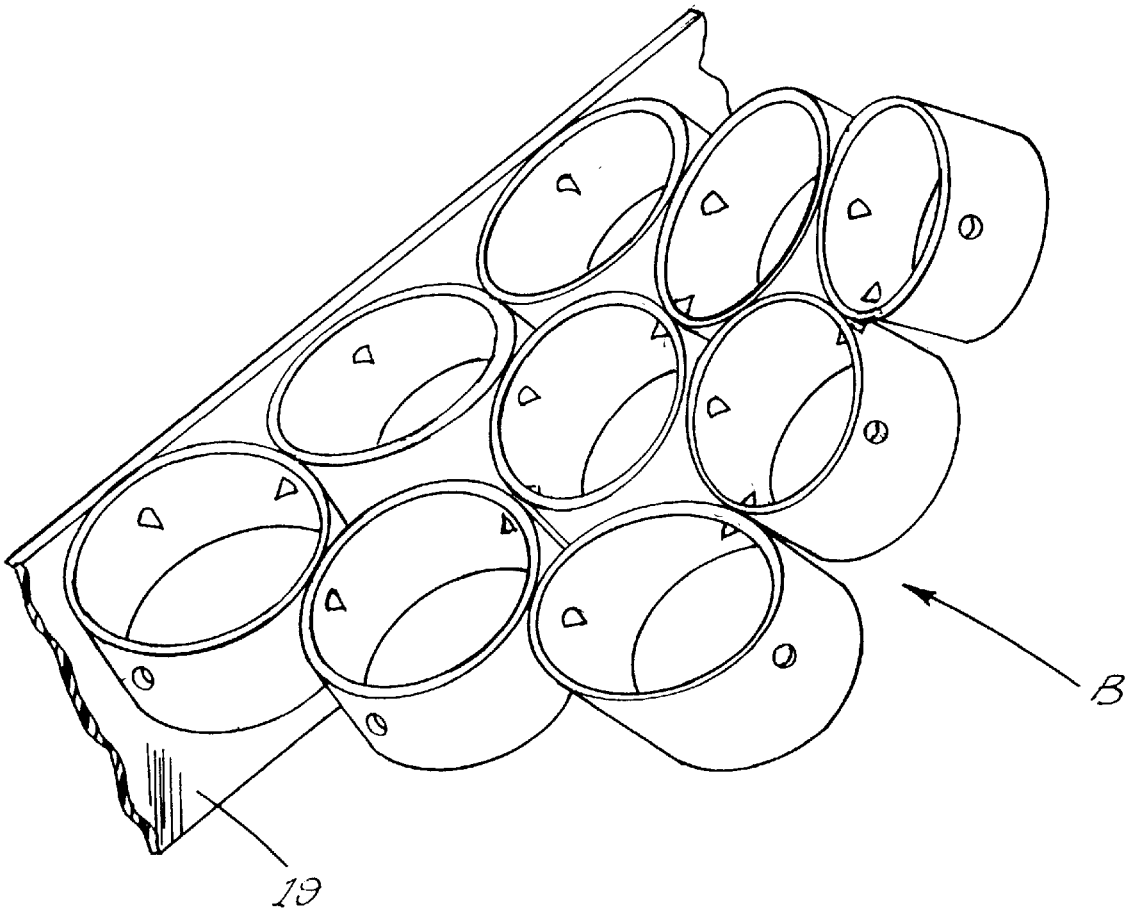
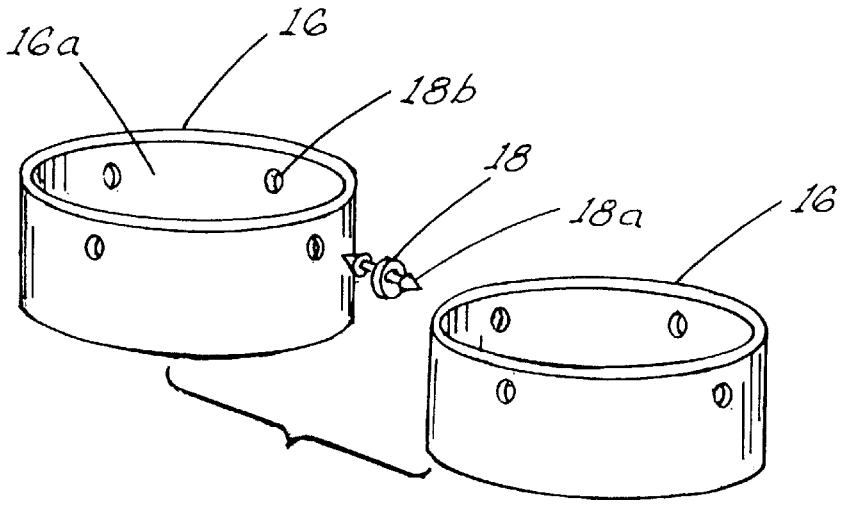
Fig. 7.

COMPOSITE ARTIFICIAL TURF STRUCTURE WITH SHOCK ABSORPTION AND DRAINAGE

BACKGROUND OF THE INVENTION

The invention relates to artificial turf construction and methods, and, more particularly, to an artificial sports turf which is easy to install and simulates the action of natural playing turf by providing proper shock absorption, improved stability, and reduced turf deflection and irregularities.

With increased leisure time, artificial turf systems for indoor and/or outdoor sports surfaces such as golf greens, golf tee pads, playing fields, golf cart paths and walkways, and other sports surfaces have become more widely used and needed. Natural golf greens typically include a sand base of about 18" in which natural grass grows. The grass is cut to a height of about 1/8–3/16 of an inch to provide a proper playing surface. The sand provides the proper cushioning and drainage, and the grass root system stabilizes the sand.

Previously, various constructions have been provided for artificial turf. For example, U.S. Pat. No. 3,795,180 discloses an artificial surface for a ballfield, patio, and the like which utilizes a plastic extruded net for drainage. U.S. Pat. No. 4,913,596 discloses a composite structure for an athletic field having a series of drain tiles covered with pea gravel which overlay a subgrade which includes a ditch for drainage. U.S. Pat. No. 4,462,184 discloses a system for improving synthetic surfaces such as artificial turf and rubberized asphalt which includes a base drainage system. U.S. Pat. Nos. 5,823,711, 5,752,784, and 5,064,308 disclose various drainage systems for athletic fields and the like.

While the above systems and structures may be suitable for their intended applications, the prior art has not provided a suitable composite structure for an artificial turf surface with low impact properties so that excessive deflections of the surface do not occur, and suitable drainage to remove water from the surface is provided. With increased demand, artificial golf turf is needed which can be easily installed and maintained.

Typically artificial golf course turf has been provided by laying artificial grass on a proper base wherein the grass has a pile range of 3/4"–2 filled with sand so that about 1/8 to 3/16 inches of the grass tips are exposed. This closely simulates a natural grass golf green which is typically maintained at about 1/8". Thus, the artificial green has a softness, deflection, and stability which provides a playing action much like a natural grass surface. In the past, crushed stone bases or concrete bases have been used below the artificial turf. However, this type of artificial construction requires installation by professional installers so that the construction and installation techniques have not been suitable for ordinary or less skilled workers to perform. Several different construction problems need to be considered if artificial golf surfaces are to be constructed using ordinary workers and lay persons as is necessary to meet the increased needs for artificial golf courses.

Basically there have been two types of artificial turf systems used in the golf industry or the sporting industry; a polypropylene fiber system and a nylon fiber system, each having different characteristics for play and, primarily, for durability. The polypropylene grasses have been used primarily as soft, shock absorbent putting greens by sweeping a specialized top dressing blend of sand into the fibers to provide the softness of the green. However, the specification has to be followed very closely in order to provide the required softness. By using a specification of an extended pile height of turf grasses, up to approximately 2", filled with sand, the desired softness that is needed can be provided. However, the problem occurs that the turf has to be filled with the sand until the actual finished turf tips are achieved. The top dressing procedure of the polypropylene grass is labor intensive, and about two to five days are required, depending on size, to construct the green using a very intensive top dressing technique which includes adding the sand gently while the fibers are brushed upright as the sand is added. Many sequential, repetitive steps of adding a light sand layer to the grass and brushing the sand are required in order to achieve the proper fill, taking considerable time, effort, and expertise.

It has not been possible to use short pile turf grasses successfully because of the firmness resulting from their short pile. Different pad arrangements have been tried underneath the short pile turfs, such as rubber, foam pads, and geotextile materials, but these arrangements have not been found to provide the shock absorbing resilience needed, and the specifications and techniques required do not lend themselves to construction by lay persons or ordinary construction workers. In order to meet the demands for artificial sports turfs, it must be possible to use lay persons to construct the turf across the country without undue supervision.

To allow someone with less experience to construct artificial turf, local, easily accessible materials, such as sand, need to be utilized in the construction. However, a particular need arises when trying to make a sporting surface base structure or, in this case, a putting green system with loose sand particles in order to keep them stable and firm. Footprints in the surface, or other soft spots would create an imperfect golf ball roll.

Accordingly, an object of the present invention is to provide a composite artificial turf structure which is simple to construct and install yet has the proper softness or shock absorption properties to simulate a natural golf green.

Another object of the present invention is to provide an artificial sports turf which does not have to be installed according to detailed, precise specifications, but may be installed by lay personnel.

Another object of the present invention is to provide an improved artificial turf structure for sports turf having increased drainage for water removal and low impact flexibility that decreases deflection of the surface to provide a natural playing action.

Yet another object of the invention is to provide a base locking grid system which provides stability for subbase construction of artificial turf systems for artificial turf and the like where stability, softness and ease of installation is important.

SUMMARY OF THE INVENTION

The above objectives are accomplished according to the present invention by providing an artificial sports turf comprised of a base surface, a deflection layer disposed above the base surface, and a layer of artificial grass overlying the deflection layer providing a generally level playing surface. The deflection layer is comprised of an open layer of upstanding resilient strands having a prescribed height or thickness. A filling of loose particles is spread into the deflection layer generally up to a prescribed level to provide stability so that the deflection layer deflects upon the artificial grass being impacted to absorb foot traffic and/or ball play yet rebound to maintain a generally uniform play action for the playing surface of the artificial grass. In a preferred embodiment, the base surface may comprise a flexible grid system having a plurality of individual cells interconnected to provide flexibility to the overall grid system to conform to a compacted subbase surface such as soil. If desired, an underlayment may be disposed below the grid system which is porous or non-porous to facilitate water drainage through or by passing the structure. The underlayment may include a geotextile fabric disposed on the compacted subbase.

The subbase may include soil, gravel, stone, concrete, asphalt, or existing poor performing artificial grass. Advantageously, the cells include individual round cells and the grid systems includes universal flex joints connecting the round cells together providing relative flexing between the round cells. Preferably, the cells include an interior filling of sand for additional stability. The flex joints include a connector connected between adjacent cells to flexibly join the adjacent cells to provide 360 degrees of flexibility between the adjacent cells.

It is possible for a lay person to construct the shock absorption system of the present invention and finish it with a short pile grass surface on top with relative ease. A small amount of fine top dressing sand is deposited into the surface of the grass which is designed to provide the look of natural grass and the smoothness and speed of the roll. For simplified building, the deflection layer has a prescribed thickness or height which is filled with sand whereby the sand and layer are stabilized. Once the deflection layer is filled with sand complete stabilization of that base is provided, and a nice finished top surface can be more easily provided. The process is not labor intensive because the short pile turf requires notably less sand and time to fill. The fine sand or material can be poured into the turf and generally without brushing into the turf because the fine sand goes readily into the turf and is actually pushed into it rather than sweeping after each layer. Installation time has been reduced significantly over conventional means of compacting crushed stone or finishing hard surfaces as concrete or asphalt.

The deflection layer designed into the system has two purposes. First, to stabilize the loose particles whether it be sand, rubber, Styrofoam particles, or other loose particles, easily shippable and containing properties that would be loose formed and difficult to compact. The second purpose is to provide a strata beneath the artificial turf to accommodate a non-uniform or imperfect base surface, such as a flexible grid system according to the invention, or an earth compacted base. In either case, the deflection layer provides a leveling course and bridges any imperfections in that base. A true smooth playing surface is provided once the artificial turf layer is finished.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 6 is a perspective view of the flexible grid system in a flexed state according to the invention; and FIG. 7 is a perspective view of individual geo cells and universal joint according to the invention.

DESCRIPTION OF A PREFERRED EMBODIMENT

Referring now in more detail to the drawings, the invention will be described in more detail.

Figure 1:
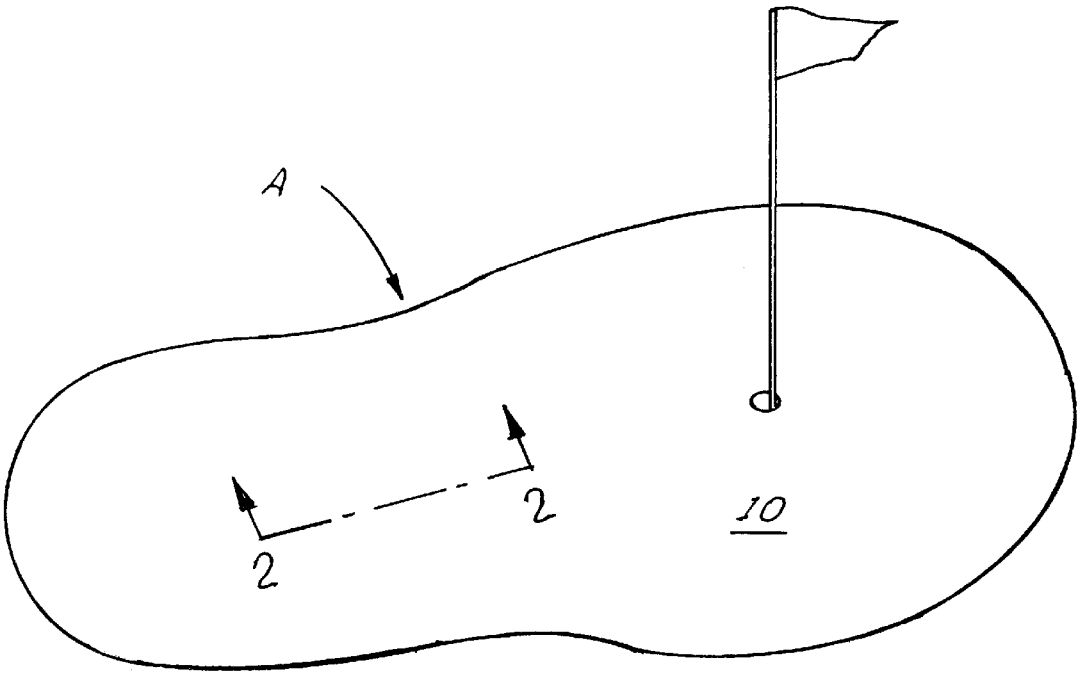
FIG. 1 is a perspective view of an artificial turf construction according to the invention with parts cut away to show the various composite construction.
Figure 2:
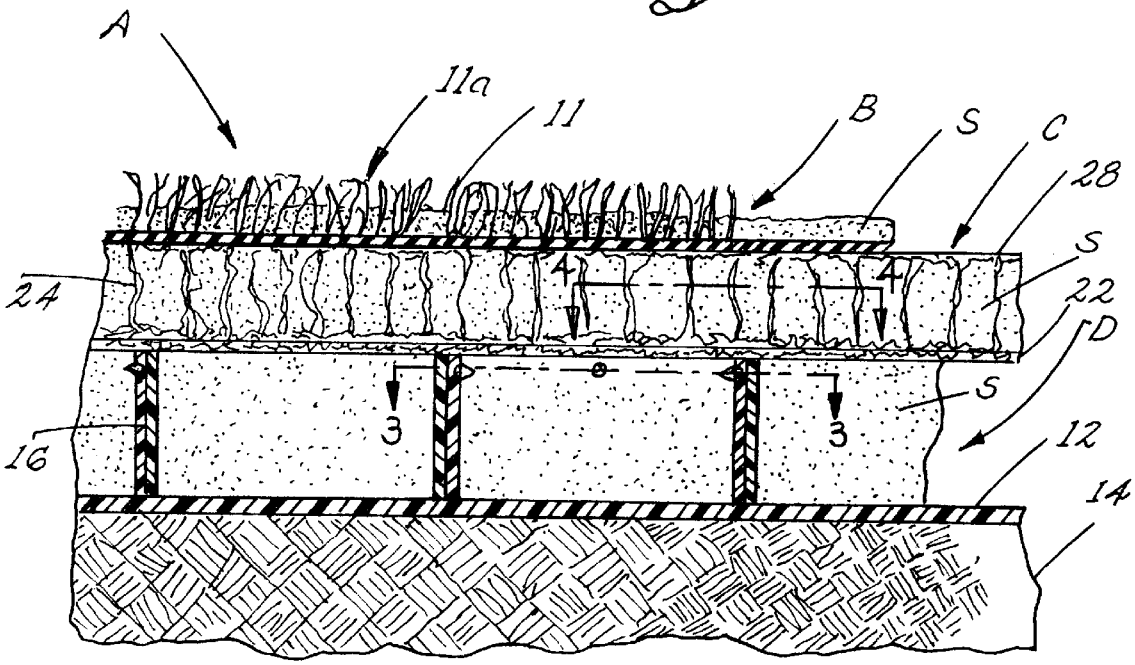
FIG. 2 is a sectional view of a composite artificial turf structure constructed according to the invention taken along line 2—2 of FIG. 1.

FIG. 1 is a perspective view of an artificial sports turf, designated generally as A, illustrated in the form of a golf green 10 constructed according to the invention. As can best be seen in the enlarged sectional view of FIG. 2, the artificial turf has a composite construction which includes an outer layer, designated generally as B, which is artificial turf. The artificial turf may be any conventional artificial grass such as that manufactured by Controlled Products, Inc. of Dalton, Ga. Preferably the artificial turf is specified to have a pile height of ¼" to ¾", with ½" to ⅝" being preferred. The artificial turf is filled with sand, approximately 3.5 lb./ft$^2$, to fill the turf up to ⅛" to 3⁄16" of the fiber pile height. This stabilizes the grass fibers 11 leaving ⅛" to 3⁄16" of their tips 11*a* exposed, and the grass fibers stabilize and hold the sand "S" in place. Next, there is a deflection layer, designated generally as C, which provides a drainage material, cushioning for green softness, and eliminates excessive deflection of the artificial turf. Below the deflection layer is a base in the form of a lower grid system, designated generally as D. Flexible base grid system D stabilizes the upper artificial turf and deflection layers B, C. Artificial grass B, deflection layer C, and grid D each include a filling of sand "S." Next, an underlayment 12 may be provided which may be a suitable geotextile material to prevent the grid system from sinking into the subbase ground soil 14. A suitable geotextile material may be provided by non-woven or woven form of polypropylene. The subbase may be provided by compacted soil or other subbase surface.

Figure 3:
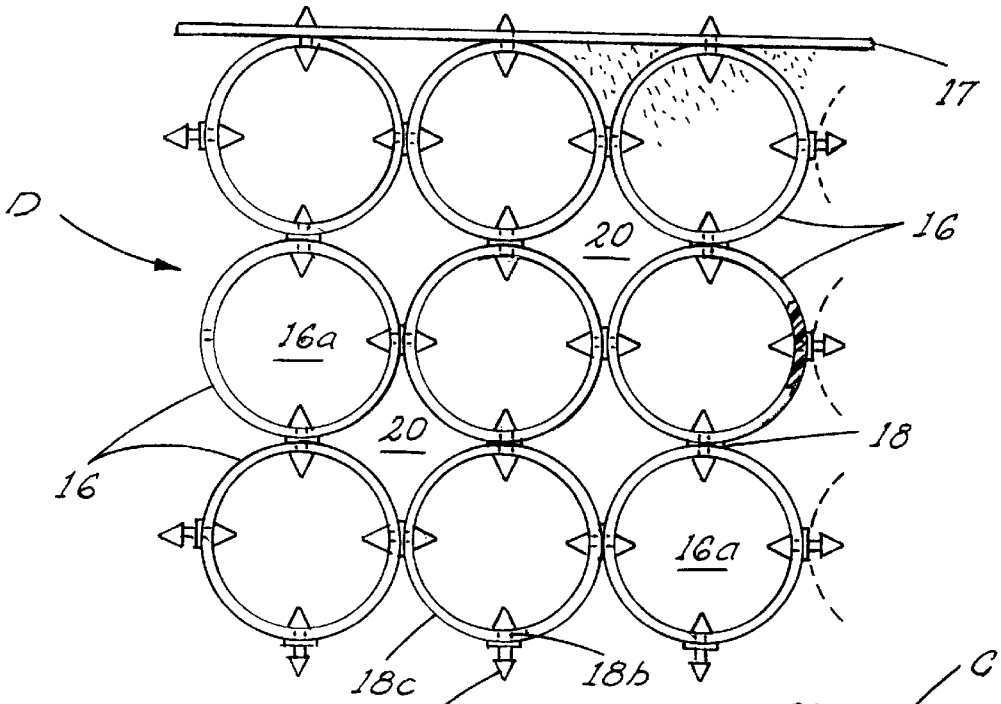
FIG. 3 is a top plan view of a flexible grid base system according to the invention.

Referring now in more detail to flexible grid base system D, as can best be seen from FIG. 3, a preferred embodiment of the system includes a plurality of grid cells 16 which are designed to stand alone or be filled with loose particles 17 or "S" for individual grid support and shock absorption. Adjacent grid cells are interlocked together by flexible universal joints 18 which include a male connector 18*a* received in a socket 18*b* formed in the sidewall 18*c* of the grid cells. While the grid cells are illustrated as circular, other forms may also be utilized. The universal joint provides flexibility in all directions. The grid cells may be joined together to provide a flexible base grid system of any desired area which readily conforms to the compacted base or subbase surface 14. A sidewall 19, to which outer cells are attached, may be provided around the completed grid system. The base grid may be manufactured with individual cells and cut in the field, or the individual cells may be joined in the field.

The grid cell interiors 16*a*, and openings 20 between cells 16, may be filed with sand, other loose particles 17. Depending on the desired application, the grid cells may be manufactured to a size that completely supports the synthetic turf top layer so deflection is eliminated. Preferably, the diameter of the cells is no more than about 4 inches, since it has been found that larger diameters allow the deflection layer and/or grass layer to deflect inwardly too much. As noted previously, underlayment 12 is a suitable geotextile material which is placed over already existing compacted base soil, stone material, concrete, asphalt, existing poor performing synthetic turf systems, or other stable base subsystem.

The universal joint mechanism of the hub cells allows the adjoining cells to be locked and released as needed and permit flexibility 360° for conforming to undulating or otherwise, less than level subbase surfaces. The locking universal joints may be manufactured as a part of the cell or the cells may be assembled with a double pointed joint apparatus separately, which enables the cells to be joined continuously through receiver holes of a smaller diameter.

Deflection layer C is supported by flexible grid system. The deflection layer may comprise a non-woven layer of synthetic fibrous material which is open for containing sand and sufficient water drainage yet has enough resiliency to provide cushioning while maintaining the designed height. The deflection layer also helps in preventing the playing surface from deflecting into the grid cells by settling, upon impact by a golf ball, foot traffic, or other similar impact. In the illustrated embodiment, deflection layer C is constructed of a non-woven, synthetic fibrous material and manufactured to a precise thickness to maintain a baffled layer or membrane which supports the artificial grass layer. The woven deflection layer may also be a multi-layer woven fabric. In addition, the layer may be affixed directly to a geotextile fabric backing 22 such as by weaving, binding, adhesive, thermal, or any other means. This provides additional strength to the deflection layer, and prevents filler sand or loose particles from falling through. Fibrous upstanding yarns 24 of the deflection layer possess sufficient resiliency to maintain the height and loft of the woven fabric to absorb shock from foot traffic or play. In addition, the grid system can be particle filled for additional strength and improved shock absorbent characteristics from impact. The loose fill system also promotes improved drainage of water in outdoor applications.

Figure 5:
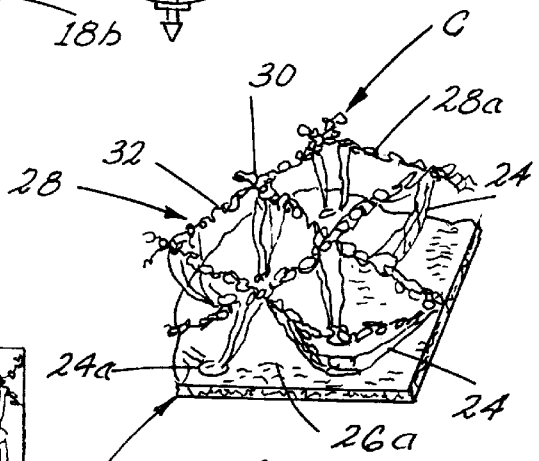
FIG. 5 is a partial perspective view of the deflection layer of FIG. 4.
Figure 4:
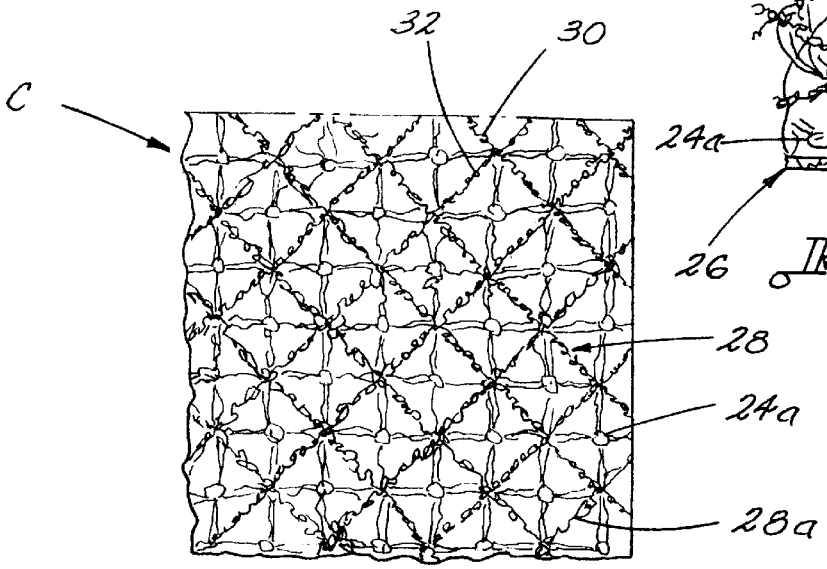
FIG. 4 is a top plan view of a deflection layer for artificial turf according to the invention.

As can best be seen in FIGS. 4 and 5, deflection layer C includes a lower side 26 of mutually entangled heat set plastic yarns 26*a* and an outer side 28 of mutually entangled plastic yarns 28*a* arranged in intersecting diagonal rows 30, 32. Upstanding yarns 24 extend between lower and upper sides 26, 28, and are mutually entangled and heat set therewith. In particular, yarns 24 are spot welded at 24*a* to lower side 26 and are mutually entangled or looped with the upper side yarns. The entire layer is heat set for resiliency. The fibrous yarns are entangled or woven together so as to prevent the disbursement and lateral movement of loose particles when applied within the layer. It has been found that a fibrous strand material with a pile height of about 1" filled with sand during installation, advantageously stabilizes the construction, i.e. the strands stabilize and anchor the sand particles in place, and provides the needed shock absorption. Preferably, the pile of the deflection layer is filled to the top, 1". So constructed, the deflection layer is resilient to rebound and assists in preventing permanent deformities and irregularities in the playing surface. A suitable construction according to the above specifications can be manufactured by the Colbond Corporation of Enka, N.C.

Thus, it can be seen that an advantageous construction procedure can be had for a composite artificial turf system for sports and the like which can be installed by an ordinary construction worker or laborer having basic mechanical skills, resulting in the desired softness for shock absorption and natural play action, and which accommodates foot traffic while affording proper water drainage.

While a preferred embodiment of the invention has been described using specific terms, such description is for illustrative purposes only, and it is to be understood that changes and variations may be made without departing from the spirit or scope of the following claims.

What is claimed is:

1. An artificial sports turf with improved stability and drainage capability comprising:

a base system having a plurality of cells, each with an interior filled with sand promoting said improved stability and drainage capability;

an outer artificial grass layer disposed above said base system providing a playing surface;

a deflection layer disposed between said base system and said artificial grass layer;

said deflection layer comprising an open layer of fibrous material of a prescribed thickness comprised of generally upstanding resilient elements with interstices defined there between; and a filling of loose particles spread around said upstanding elements and within said interstices of said deflection layer up to a prescribed level promote stability and drainage so that said deflection layer sufficiently absorbs impacts upon said artificial grass to maintain a natural play action for said playing surface.

2. The structure of claim 1 wherein said base system comprises a flexible grid system having a plurality of individual cells interconnected together to provide flexibility to said grid system, and a subbase on which said grid system is disposed in a manner to conform to said subbase.

3. The structure of claim 2 comprising an underlayment disposed between said base system and subbase which is one of a porous or non-porous subbase to facilitate water drainage through said structure or restrict water movement into the system from outside sources.

4. The structure of claim 3 wherein said underlayment includes a geotextile fabric disposed on said subbase having semi-rigid characteristics to prevent the grid system of said base system from being pushed into the subbase.

5. The structure of claim 4 wherein said subbase comprises one of a compacted soil, gravel, stone, concrete, asphalt, or existing, poor performing artificial turf systems.

6. The structure of claim 2 wherein said cells include individual round cells and said grid system includes universal flex joints connecting said round cells together providing relative flexing between said round cells to conform to said sub-base.

7. The structure of claim 2 wherein said cells are circular and have a diameter equal to or less that approximately 4 inches.

8. The structure of claim 6 wherein said connector includes a shaft extending between adjacent cells having interlocking elements carried on opposing ends which penetrate said cells to flexibly connect said cells together.

9. The structure of claim 1 wherein said deflection layer has a height of up to about 1".

10. The structure of claim 9 wherein said deflection layer is filled with sand or other loose particles to a height generally equal to the height of said deflection layer.

11. The structure of claim 1 wherein said deflection layer includes a geotextile backing secured to a lower side thereof.

12. The structure of claim 1 wherein said deflection layer comprises an upper side spaced above a lower side, and said upstanding resilient elements include upstanding resilient strands extending between said lower and upper sides.

13. The structure of claim 1 wherein said outer grass layer includes grass fiber pile of a height in the range of between about ¼ to ¾ of an inch.

14. The structure of claim 13 wherein said pile height is between about ½ to ⅝ of an inch.

15. An artificial turf comprising:

an outer artificial grass layer having a generally uniform exterior playing surface;

a deflection layer disposed below said artificial grass layer, said deflection layer having a prescribed resilience and height for absorbing impact shocks from foot traffic and playing on said artificial grass layer, said deflection layer having a plurality of interstices providing open passages for water drainage;

loose particles filling said interstices of said deflection layer up to a prescribed level to provide stability and enhance shock absorption so that said deflection layer deflects when said artificial grass is impacted to assist in absorbing said impact while maintaining normal playing action of the playing surface of said artificial grass layer; and a base system supported on a sub-base surface and disposed below said deflection layer said base system includes a grid system comprised of a plurality of individual cells and flex joints, said flex joints interconnecting each adjacent of said cells in a manner providing flexibility.

said base system substantially conforms with the surface of said sub-base surface providing stability, drainage, and rebound for the deflection layer.

16. The structure of claim 15 comprising a geotextile fabric disposed below said grid system which is one of a porous or non-porous subbase to facilitate water drainage through said structure, and/or for prevention of water migration from outside sources.

17. The structure of claim 16 wherein said geotextile fabric is disposed on a compacted subbase which includes one of soil, gravel, stone, rock, concrete, sand, asphalt, or existing, poorly performing artificial turf system.

18. The structure of claim 15 wherein said artificial grass has a pile height of less than about ¾ of an inch.

19. The structure of claim 18 wherein said pile height is about ½ to ⅝ of an inch.

20. The structure of claim 15 wherein said cells are circular and have a diameter equal to or less that approximately 4 inches.

21. The structure of claim 15 wherein said deflection layer has a height of less than or equal to about 1".

22. The structure of claim 21 wherein said prescribed filling is generally equal to the height of said deflection layer.

23. The structure of claim 15 wherein said deflection layer includes a geotextile backing secured to a lower side thereof, said backing preventing loose particles from falling through.

24. The structure of claim 23 wherein said deflection layer comprises an upper side spaced above said lower side, and upstanding resilient strands extending between said lower and upper sides.

25. An artificial sports turf comprising:

a sub-base surface;

an outer layer of artificial grass having a generally smooth playing surface;

a resilient deflection layer disposed below said artificial grass layer, said deflection layer including a lower side and an outer side of mutually entangled yarns forming a grid of intersecting rows and upstanding strands extending between and separating said outer and lower sides;

a flexible grid system disposed below said deflection layer and above said sub-base surface which includes a plurality of individual open-top cells interconnected together to be conformable to said sub-base surface to assist in absorbing impacts from foot traffic and playing upon said artificial grass; and, said cells each include a cell interior defined by a sidewall, and said cell interiors include a filling of sand.

26. The structure of claim 25 wherein said layer of artificial grass has a pile height is about ½ to ⅝ of an inch.

27. The structure of claim 25 wherein said upstanding strands are resilient strands generally having a given height across an upper surface of said deflection layer; and a filling of loose particles spread into said deflection layer up to a prescribed level to provide stability so that said deflection layer absorbs impacts upon said artificial grass to maintain a natural play action of said playing surface.

28. The structure of claim 27 wherein said deflection layer has a thickness of about 1 inch.

29. The structure of claim 25 wherein said cells include individual round cells and said grid systems include universal flex joints connecting said round cells together providing relative flexing between said round cells to conform to said base surface.

* * * * *